US010024074B1

(12) United States Patent
Stevig et al.

(10) Patent No.: US 10,024,074 B1
(45) Date of Patent: Jul. 17, 2018

(54) SEISMIC DAMPING SYSTEMS AND METHODS

(71) Applicant: STATE FARM MUTUAL AUTOMOBILE INSURANCE COMPANY, Bloomington, IL (US)

(72) Inventors: Larry Stevig, Bloomington, IL (US); Brandon Ross Richard, Las Vegas, NV (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

(21) Appl. No.: 15/345,110

(22) Filed: Nov. 7, 2016

(51) Int. Cl.
*E04H 9/02* (2006.01)
*E04B 1/98* (2006.01)

(52) U.S. Cl.
CPC ..... *E04H 9/023* (2013.01); *E04B 1/985* (2013.01)

(58) Field of Classification Search
CPC ..... E04H 9/023; E04H 9/021; E04H 9/02; E04B 1/985
USPC ..... 52/167.1, 167.4, 167.5, 167.7, 167.9
See application file for complete search history.

(56) References Cited

U.S. PATENT DOCUMENTS 3,762,114 A * 10/1973 Eskijian ..... E04H 9/023 52/167.4
5,653,062 A * 8/1997 Shustov ..... E04B 1/98 52/1
6,085,473 A * 7/2000 Teramachi ..... E04H 9/023 52/167.1
6,164,022 A * 12/2000 Ishikawa ..... B23Q 1/48 52/167.1
6,631,593 B2 * 10/2003 Kim ..... E04H 9/023 248/562

(Continued)

FOREIGN PATENT DOCUMENTS

JP 2006291680 A * 10/2006

OTHER PUBLICATIONS

Tsai, Chong-Shien, Advanced Base Isolation Systems for Light Weight Equipments, (2012) Earthquake-Resistant Structures Design, Assessment and Rehabilitation, Prof. Abbas Moustafa (Ed.), ISBN: 978-953-51/0123-9, InTech, Available from http://cdn.intechweb.org/pdfs/30127.pdf (Year: 2012).*
Machine translation of foreign reference JP 2006-291680 obtained from https://www4.j-platpat.inpit.go.jp/cgi-bin/tran_web_cgi_ejje?u=http://www4.j-platpat.inpit.go.jp/eng/translation/20180210051227734181178419148654 21FB015B5C22F18D6835506C53378BE2A4 (last accessed on Feb. 9, 2018) (Year: 2018).*

(Continued)

*Primary Examiner* — Theodore V Adamos
(74) *Attorney, Agent, or Firm* — Marshall, Gerstein & Borun LLP; Randall G. Rueth

(57) ABSTRACT

A system for damping seismic motions transmitted from a foundation to an architectural structure is disclosed. During a seismic event, the seismic damping system may permit bi-directional horizontal movement of the foundation relative to the architectural structure, while simultaneously providing the architectural structure with uplift restraint. The seismic damping system may include upper and lower rail members connected to each other via a bearing assembly. Respective concave surfaces may be formed in the upper and lower rail members to define first and second rolling or sliding paths for the bearing assembly. To limit vertical movement of the architectural structure during seismic motions, the bearing assembly may incorporate uplift restraint members for engaging the upper and lower rail members. Methods of assembling and operating such seismic damping systems are also disclosed.

26 Claims, 5 Drawing Sheets

(56) References Cited

U.S. PATENT DOCUMENTS 7,530,555 B2 * 5/2009 Chuang ..... E04H 9/022 248/638
8,739,985 B2 * 6/2014 Krummell ..... B65G 1/026 211/151
2002/0166296 A1 * 11/2002 Kim ..... E04H 9/023 52/167.5
2006/0000159 A1 * 1/2006 Tsai ..... E04H 9/023 52/167.4
2006/0045672 A1 * 3/2006 Maynard ..... B25J 5/02 414/276
2006/0174555 A1 * 8/2006 Zayas ..... E04H 9/023 52/167.4
2007/0125930 A1 * 6/2007 Tsai ..... E04H 9/023 248/580
2007/0130848 A1 * 6/2007 Tsai ..... E04H 9/023 52/167.7
2008/0120927 A1 * 5/2008 Tsai ..... E04H 9/023 52/167.4
2011/0016805 A1 * 1/2011 Tsai ..... E04H 9/023 52/167.1
2012/0138402 A1 * 6/2012 Choi ..... E04H 9/02 188/381
2015/0374127 A1 * 12/2015 Marino ..... E04H 9/023 211/134

OTHER PUBLICATIONS

Roussis, P.C. et al. Experimental and Analytical Studies of Structures Seismically Isolated with an Uplift-Restraint Isolation System. Multidisciplinary Center for Earthquake Engineering Research, Technical Report MCEER-05-0001, published on Jan. 10, 2005.

Constantinou, M.C. et al. Experimental and Analytical Study of the XY Friction Pendulum Bearing. Multidisciplinary Center for Earthquake Engineering Research, Technical Report MCEER-07-0009, published on Jun. 7, 2007, [online], [retrieved on Apr. 4, 2016]. Retrieved from the Internet °°URL: https://www.researchgate.net/publication/245282150_Experimental_Study_of_the_XY-Friction_Pendulum_Bearing_for_Bridge_Applications>>.

Whittaker, A. et al. Theoretical Studies of the XY-FP Seismic Isolation Bearing for Bridges. Journal of Bridge Engineering, pp. 631-638, published Nov. 2010, [online], [retrieved on May 18, 2016]. Retrieved from the Internet <URL: <https://www.researchgate.net/publication/245281948_Theoretical_studies_of_the_XY-FP_seismic_isolation_bearing_for_bridges>>.

* cited by examiner

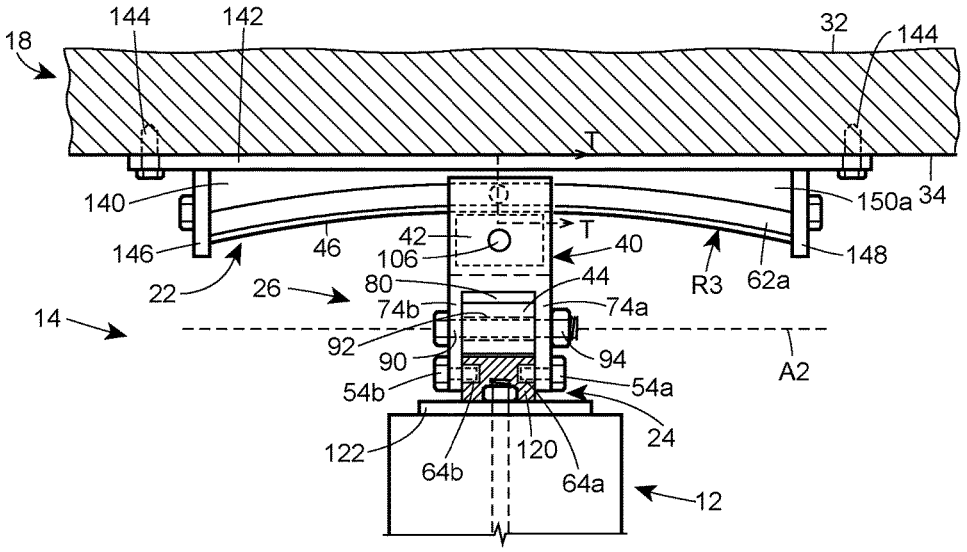
Fig. 4
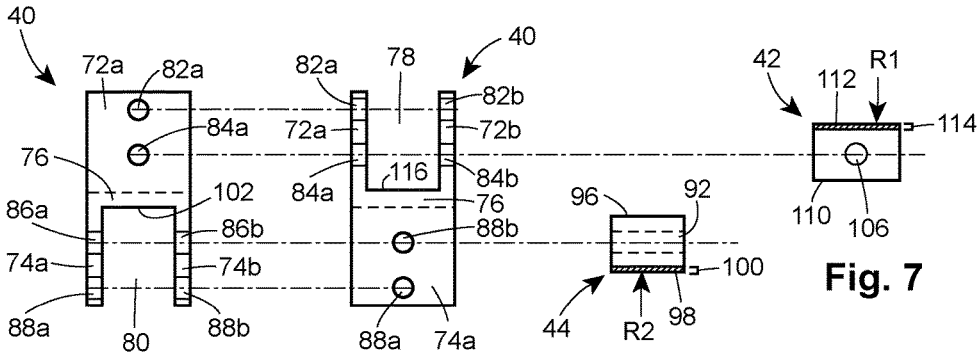
Fig. 5a
Fig. 5b
Fig. 6
Fig. 7

SEISMIC DAMPING SYSTEMS AND METHODS

FIELD OF THE DISCLOSURE

The present disclosure generally relates to systems and methods for protecting a structure from seismic activity, and more particularly, to systems and methods for damping seismic motions transmitted from a foundation to an architectural structure.

BACKGROUND OF THE DISCLOSURE

Architectural structures, such as office buildings, retail stores, churches, government facilities, warehouses, hospitals, apartments, houses, etc., built in earthquake-prone areas sometimes are constructed with a base isolation system. During an earthquake or other sudden ground motion, an architectural structure without a base isolation system may accelerate very quickly. This acceleration, combined with the weight of the architectural structure, can lead to substantial, and potentially damaging, inertial forces in the supporting members of the architectural structure.

Base isolations systems help protect against earthquake damage by reducing the amount of acceleration experienced by the architectural structure. In general, base isolation systems operate by converting kinetic energy associated with the shock of the earthquake into another form of energy, usually heat, which is then dissipated. The base isolation system, in effect, de-couples movement of the foundation from movement of the architectural structure. Though the architectural structure will still move during the earthquake, the architectural structure will accelerate at a slower rate than the foundation, because of the energy dissipated by the base isolation system. Accordingly, the architectural structure may experience less severe inertial forces as a result of the base isolation system.

Conventional base isolation systems tend to be very complex and/or require specialized installation techniques. Furthermore, base members of the architectural structure may require modification to accommodate a conventional base isolation system. Consequently, conventional base isolation systems tend to be costly and therefore limited to high value structures such as skyscrapers, hospitals, laboratories, bridges, elevated roadways, and the like. Lower value structures, such as residential buildings, usually are not installed with a base isolation system, because their lower value may not justify the expense and time of installing a base isolation system.

Another issue with many conventional base isolation systems is that they usually incorporate a horizontal rolling element positioned between the foundation and architectural structure. Therefore, they may be unable to provide an architectural structure with vertical restraint needed to resist wind uplift forces and/or overturning forces due to lateral loading from wind or earthquakes. The lack of uplift restraint can render the architectural structure susceptible to damage from upward vertical forces, which have the potential to move the structure off its foundation.

The present disclosure sets forth seismic damping systems and related methods embodying advantageous alternatives to existing seismic damping systems and methods, and that may address one or more of the challenges or needs described herein.

SUMMARY

One aspect of the present disclosure provides a system for damping seismic motions transmitted to a structure. The system may include upper and lower rail members, a connector bracket disposed between the upper and lower rail members, upper and lower bearing members, and first and second uplift restraint members. The upper rail member may have a first concave surface and a first groove. The first concave surface may face in a downward direction and define a first rolling or sliding path in a first direction. The lower rail member may include a second concave surface and a second groove. The second concave surface may face in an upward direction and define a second rolling or sliding path in a second direction. The upper bearing member may be disposed between a first pair of opposing walls of the connector bracket and configured to slide or roll against the first concave surface in the first direction during seismic motions. The lower bearing member may be disposed between a second pair of opposing walls of the connector bracket and configured to slide or roll against the second concave surface in the second direction during seismic motions. The first uplift restraint member may extend inwardly from one of the walls of the first pair of opposing walls and may be received in the first groove. The second uplift restraint member may extend inwardly from one of the walls of the second pair of opposing walls and may be received in the second groove.

Another aspect of the present disclosure provides a bearing assembly for a seismic damping system including a connector bracket, first and second bearing members, a first pair of uplift restraint members, and a second pair of uplift restraint members. The connector bracket may include a first pair of opposing walls defining an upper cavity and a second pair of opposing walls defining a lower cavity. The first bearing member may be disposed in the upper cavity and may be connected between the first pair of opposing walls. The second bearing member may be disposed in the lower cavity and may be connected between the second pair of opposing walls. The first pair of uplift restraint members may extend into the upper cavity from respective walls of the first pair of opposing walls. The second pair of uplift restraint members may extend into the lower cavity from respective walls of the second pair of opposing walls.

Yet another aspect of the present disclosure provides a method of assembling a seismic damping system including an upper rail member, a lower rail member, and a connector bracket. The method may include: (a) connecting an upper bearing member between a first pair of opposing walls of the connector bracket; (b) connecting a lower bearing member between a second pair of opposing walls of the connector bracket; (c) arranging an upper rail member between the first pair of opposing walls of the connector bracket such that a downwardly facing concave surface of the upper rail member engages the upper bearing member; (d) arranging a lower rail member between the second pair of opposing walls of the connector bracket such that an upwardly facing concave surface of the lower rail member engages the lower bearing member; (e) inserting a first uplift restraint member through a first hole in the connector bracket and into a first groove in the upper rail member; and (f) inserting a second uplift restraint member through a second hole in the connector bracket and into a second groove in the lower rail member.

BRIEF DESCRIPTION OF THE DRAWINGS

It is believed that the disclosure will be more fully understood from the following description taken in conjunction with the accompanying drawings. Some of the drawings may have been simplified by the omission of selected elements for the purpose of more clearly showing other elements. Such omissions of elements in some drawings are not necessarily indicative of the presence or absence of particular elements in any of the exemplary embodiments, except as may be explicitly delineated in the corresponding written description. Also, none of the drawings are necessarily to scale.

FIG. 4 is a cross-sectional view of the seismic damping system taken along line V-V of FIG. 2;

FIGS. 5*a* and 5*b* are side views of a connector bracket of the seismic damping system shown in FIG. 2;

FIG. 6 is a side view of a lower bearing member of the seismic damping system shown in FIG. 2;

FIG. 7 is an end view of an upper bearing member of the seismic damping system shown in FIG. 2;

DETAILED DESCRIPTION

Figure 1:
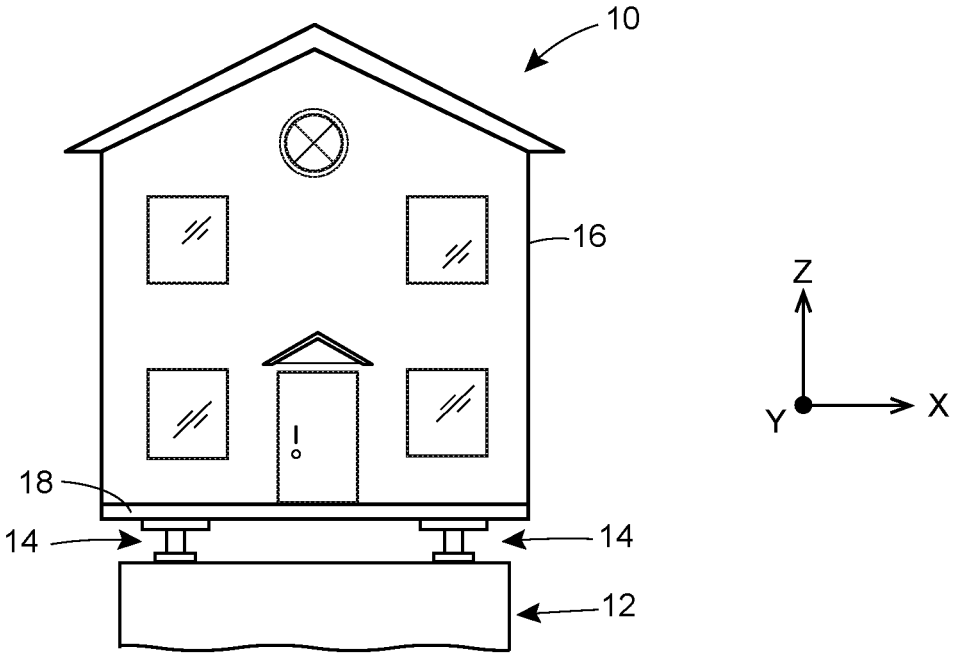
FIG. 1 is a schematic illustration of an architectural structure installed with an embodiment of a seismic damping system according to principles of the present disclosure.

FIG. 1 is a schematic illustration of an architectural structure 10 supported by a foundation 12 and installed with a seismic damping system 14 according to principles of the present disclosure. The architectural structure 10 includes framing 16 and a base member 18 which transfers the weight of the framing 16 to the foundation 12. The seismic damping system 14 may include an upper rail member 22 fixedly connected to the base member 18, a lower rail member 24 fixedly connected to the foundation 12, and a bearing assembly 26 connected between the upper rail member 22 and the lower rail member 24.

In general, the seismic damping system 14 enables bi-directional horizontal movement (e.g., x-direction movement and y-direction movement) of the foundation 12 relative to the architectural structure 10 during a seismic event such as an earthquake or other sudden ground motion. As described below in more detail, the seismic damping system 14 includes first and second concave surfaces which interface with respective upper and lower bearing members to provide for bi-directional horizontal movement. Friction between the concave surfaces and their respective bearing members may convert a portion of the kinetic energy released by the seismic event into heat, which is subsequently dissipated to the surrounding environment. As a result, horizontal movement of the architectural structure 10 may trail horizontal movement of the foundation 12, and the horizontal acceleration experienced by the architectural structure 10 may be of a lesser magnitude than that experienced by the foundation 12. Accordingly, the inertial forces experienced by the architectural structure 10 may be reduced or dampened, which makes it less likely that the architectural structure 10 is damaged by the seismic motions. Though the seismic damping system 14 permits bi-directional horizontal movement of the architectural structure 10 relative to the foundation 12, the seismic damping system 14 may be configured to restrain vertical (e.g., z-direction) movement of the architectural structure 10 relative to the foundation 12. The uplift restraint capability advantageously protects lighter structures, such as single-family homes and other residential construction, from being lifted off their foundations. As described in more detail below, the uplift restraint capability of the seismic damping system 14 may be accomplished by a plurality of uplift restraint members received by corresponding grooves in the upper and lower rail members 22 and 24. The uplift restraint members may be separate from the bearing members to facilitate their installation and improve their ability to hold down the architectural structure 10.

Each of the foregoing components of the seismic damping system 14, and methods of assembling and operating the seismic damping system 14, will now be described in more detail.

Referring to FIG. 1, the architectural structure 10 may be a residential structure, such as a single-family home, and the framing 16 and/or the base member 18 may be constructed of wood, steel, aluminum, or any other suitable material for residential construction. In some embodiments, the framing 16 and/or the base member 18 may have a rectangular cross-section having nominal dimensions measuring approximately two inches by four inches (colloquially referred to as a "two-by-four"), or nominal dimensions measuring approximately two inches by six inches, or nominal dimensions measuring approximately two inches by eight inches, nominal dimensions measuring approximately two inches by ten inches. The foundation 12 may be buried, completely or partially, in the ground, and may be made of concrete, masonry, stone, or any other material having a sufficient compressive strength to support the architectural structure 10.

The architectural structure 10 illustrated in FIG. 1 is representative of a residential structure (e.g., a single-family home) having light-frame wood structural components. However, the base isolation systems of the present disclosure are not limited to residential structures and may be installed in any light-frame stationary structure including, but not limited to, a commercial building, multi-family residential building, or even a single room or floor of a building, or even large machinery or equipment.

The base member 18 may extend horizontally and may be disposed between the framing 16 and the foundation 12 such that the base member 18 transfers the weight of the framing 16, and the rest of the architectural structure 10, to the foundation 12. As used herein, the term "horizontal" refers to any direction that is non-parallel to the direction of the earth's gravity at the surface of the earth including, but not limited to, any direction that is perpendicular to the direction of the earth's gravity at the surface of the earth. As used herein, the term "vertical" refers to any direction that is parallel to the direction of earth's gravity at the surface of the earth. In some implementations, the base member 18 may function as a sill plate. As shown in FIG. 4, the base member 18 may include a planar upper surface 32 and a planar lower surface 34 which are parallel to each other. The planar upper surface 32 may face in an upward vertical direction toward the framing 16, and the planar lower surface 34 may face in a downward vertical direction toward the foundation 12.

Figure 2:
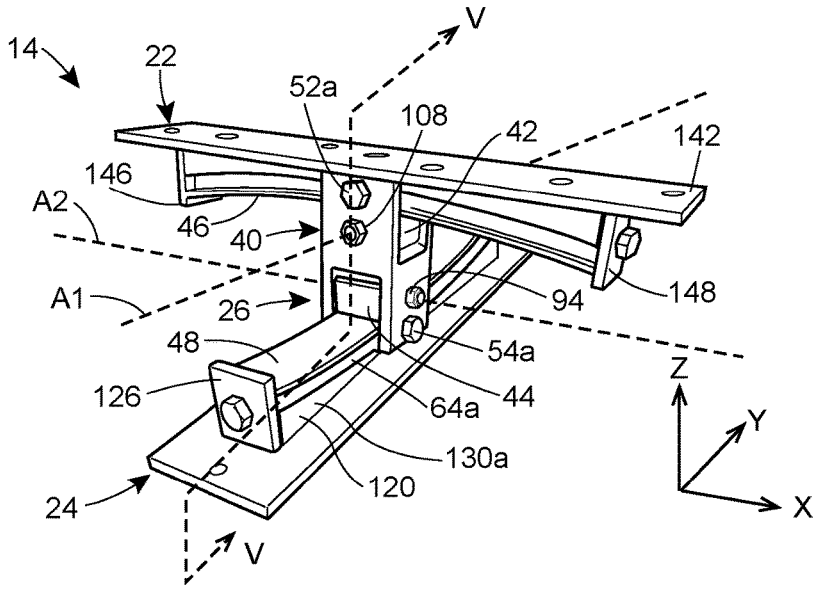
FIG. 2 is a front perspective view of an embodiment of a seismic damping system according to principles of the present disclosure.
Figure 3:
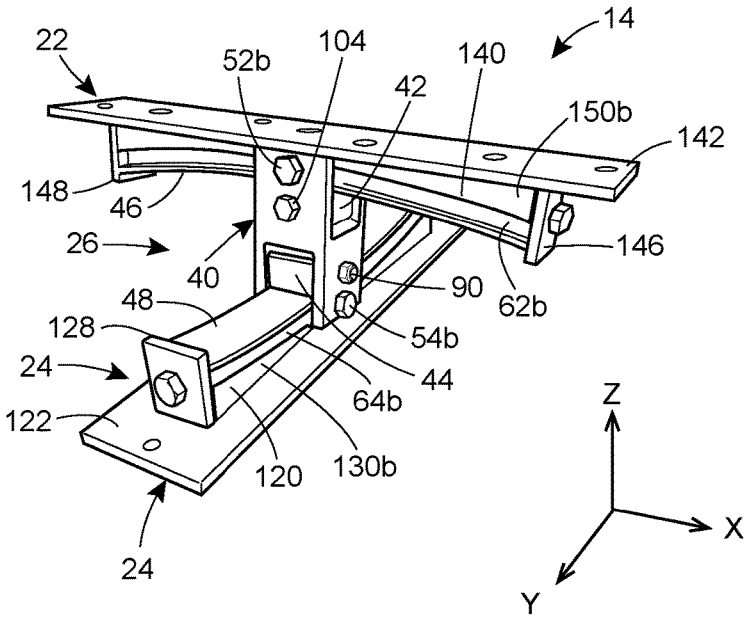
FIG. 3 is a rear perspective view of the seismic damping system shown in FIG. 2.

Turning to FIGS. 2-4, the components of one embodiment of the seismic damping system 14 will now be described. In general, the seismic damping system 14 isolates or decouples horizontal movement of the architectural structure 10 from the foundation 12, while simultaneously providing the architectural structure 10 with bearing support and uplift restraint. The functionalities are enabled by connecting the upper and lower rail members 22 and 24 with the bearing assembly 26. The bearing assembly 26 may include a connector bracket 40, an upper bearing member 42 mounted to the connector bracket 40 and configured to slide against a downwardly facing concave surface 46 of the upper rail member 22, and a lower bearing member 44 mounted to the connector bracket 40 and configured to slide against an upwardly facing concave surface 48 of the lower rail member 24. In alternative embodiments, the upper and lower bearing members 42 and 44 may be configured to roll, instead of slide, against the downwardly facing concave surface 46 and the upwardly facing concave surface 48, respectively. The upper rail member 22 may be arranged perpendicular (e.g., arranged at a 90 degree angle) relative to the lower rail member 24. Accordingly, the rolling or sliding path defined by the downwardly facing concave surface 46 may extend in a first direction, and the rolling or sliding path defined by the upwardly facing concave surface 48 may extend in a second direction perpendicular to the first direction. The orthogonal arrangement of the upper and lower rail members 22 and 24 enables bi-directional horizontal movement (e.g., x-direction movement and y-direction movement) of the foundation 12 relative to the architectural structure 10 during seismic motions. Furthermore, the vertical distance separating the upper and lower rail members is maintained or limited by a first pair of uplift restraint members 52*a* and 52*b* and a second pair of uplift restraint members 54*a* and 54*b*. Each of the uplift restraint members 52*a*, 52*b*, 54*a*, and 54*b* extends through a respective hole in the connector bracket 40 and is received in a respective groove 62*a*, 62*b*, 64*a*, or 64*b* formed in the upper rail member 22 or the lower rail member 24. As such, vertical separation of the upper and lower rail members 22 and 24 is prevented or inhibited by the uplift restraint members 52*a*, 52*b*, 54*a*, and 54*b*.

Referring to FIGS. 5*a* and 5*b*, the connector bracket 40 may be include a plurality of interconnected and integrally formed walls. A first pair of opposing walls 72*a* and 72*b* may define an upper end of the connector bracket 40, and a second pair of opposing walls 74*a* and 74*b* may define a lower end of the connector bracket 40. The first pair of opposing walls 72*a* and 72*b* may be parallel to each other, but perpendicular to the second pair of opposing walls 74*a* and 74*b*. Similarly, the second pair of opposing walls 74*a* and 74*b* may be parallel to each other, but perpendicular to the first pair of opposing walls 72*a* and 72*b*. Additionally, the connector bracket 40 may include an interior wall 76 which extends between the first pair of opposing walls 72*a* and 72*b* and also between the second pair of opposing walls 74*a* and 74*b*. The interior wall 76 may separate the interior of the connector bracket 40 into two cavities: an upper cavity 78 defined by the interior wall 76 and the first pair of opposing walls 72*a* and 72*b*; and a lower cavity 80 defined by the interior wall 76 and the second pair of opposing walls 74*a* and 74*b*. In at least one embodiment, the upper and lower cavities 78 and 80 each may have a square or rectangular cross-sectional shape. The connector bracket 40 may be made of a rigid material capable of supporting compressive and tensile loads such as metal (e.g., steel or stainless steel).

One or more holes may be formed in the connector bracket 40 and may be configured to receive the uplift restraint members 52*a*, 52*b*, 54*a*, and 54*b* and/or bolts for mounting the upper and lower bearing members 42 and 44. As shown in FIGS. 5*a* and 5*b*, an upper hole 82*a* and a lower hole 84*a* are formed in the wall 72*a*, and an upper hole 82*b* and a lower hole 84*b* are formed in the wall 72*b*. The upper holes 82*a* and 82*b* may be centrally axially aligned with each other, and the lower holes 84*a* and 84*b* may be centrally axially aligned with each other. Similarly, an upper hole 86*a* and a lower hole 88*a* are formed in the wall 74*a*, and an upper hole 86*b* and a lower hole 88*b* are formed in the wall 74*b*. The upper holes 86*a* and 86*b* may be centrally axially aligned with each other, and the lower holes 88*a* and 88*b* may be centrally axially aligned with each other. In some embodiments, the upper holes 82*a* and 82*b* and the lower holes 88*a* and 88*b* each may have a threaded interior surface to threadably engage a threaded exterior surface of a respective one of the uplift restraint members 52*a*, 52*b*, 54*a*, and 54*b*.

Turning to FIG. 6, illustrated is a side view of the lower bearing member 44. The lower bearing member 44 may be disposed in the lower cavity 80 of the connector bracket 40 and connected between the second pair of opposing walls 74*a* and 74*b*. As shown in FIG. 4, this connection may be achieved by inserting a bolt 90 through the lower holes 88*a* and 88*b* in the connector bracket 40 and through a hole 92 in the lower bearing member 42, and then tightening the bolt 90 against the connector bracket 40 with a nut 94. This relatively straightforward assembly of the lower bearing member 44 may help simplify and/or quicken installation of the seismic damping system 14.

Still referring to FIG. 6, the lower bearing member 44 may possess an upwardly facing planar surface 96 and a downwardly facing convex surface 98. During seismic motions, the downwardly facing convex surface 98 may slide against the upwardly facing concave surface 48 of the lower rail member 24. To facilitate this sliding motion, the downwardly facing convex surface 98 and the upwardly facing concave surface 48 of the lower rail member 24 may define concentric curves (e.g., concentric circular curves). Furthermore, to facilitate sliding, the downwardly facing convex surface 98 may be formed by sliding material layer 100. In at least one embodiment, the sliding material layer 100 made by made of polytetrafluoroethylene (PTFE). Besides the sliding material layer 100, the lower bearing member 44 may be constructed of metal (e.g., stainless steel). Furthermore, in some embodiments, a radius of curvature R2 of the downwardly facing convex surface 98 may be within a range of approximately (e.g., ±10%) 40.0-60.0 inches, or within a range of approximately (e.g., ±10%) 45.0-55.0 inches, or within a range of approximately (e.g., ±10%) 48.0-52.0 inches, or approximately (e.g., ±10%) 49 29/32 inches.

In the illustrated embodiment, the lower bearing member 44 is rotatably connected to the connector bracket 40 via the bolt 90, thereby enabling the lower bearing member 44 to rotate about a rotational axis A2. Rotation of the lower bearing member 44 helps maintain flush engagement between the downwardly facing convex surface 98 and the upwardly facing concave surface 48 while these surfaces slide against each another during seismic motions. The upwardly facing planar surface 96 of the lower bearing member 44 may be spaced apart from a downwardly facing surface 102 of the interior wall 76 so that there is clearance for the lower bearing member 44 to rotate. This clearance may be less than what is needed for the lower bearing member 44 to rotate a full 360 degrees within the lower cavity 80. In an alternative embodiment (not illustrated), the lower bearing member 44 may have a circular cross section and may be configured to rotate 360 degrees around the rotational axis A2. In such an embodiment, the lower bearing member 44 may roll, instead of slide, against the upwardly facing concave surface 48 of the lower rail member 24 during seismic motions. In a further alternative embodiment (not illustrated), the lower bearing member 44 may be fixed relative to the connector bracket 40, or even integrally formed with the connector bracket 40, such that the lower bearing member 44 does not rotate or otherwise move relative to the connector bracket 40 during seismic motions.

The upper bearing member 42 may be configured and function in a similar manner as the lower bearing member 44 described above. The upper bearing member 42 may be disposed in the upper cavity 78 of the connector bracket 40 and connected between the first pair of opposing walls 72*a* and 72*b*. As shown in FIGS. 2 and 3, this connection may be achieved by inserting a bolt 104 (not illustrated in FIG. 4) through the lower holes 84*a* and 84*b* in the connector bracket 40 and through a hole 106 in the upper bearing member 42, and then tightening the bolt 104 against the connector bracket 40 with a nut 108. This relatively straightforward assembly of the upper bearing member 42 may help simplify the installation of the seismic damping system 14.

Looking to FIG. 7, the upper bearing member 42 may possess a downwardly facing planar surface 110 and an upwardly facing convex surface 112. During seismic motions, the upwardly facing convex surface 112 may slide against the downwardly facing concave surface 46 of the upper rail member 22. To facilitate this sliding motion, the upwardly facing convex surface 112 and the downwardly facing concave surface 46 of the upper rail member 22 may define concentric curves. Furthermore, to facilitate sliding, the upwardly facing convex surface 112 may be formed by a sliding material layer 114. In at least one embodiment, the sliding material layer 114 made by made of polytetrafluoroethylene (PTFE). Besides the sliding material layer 114, the upper bearing member 42 may be constructed of metal (e.g., steel or stainless steel). Furthermore, in some embodiments, a radius of curvature R1 of the upwardly facing convex surface 112 may be within a range of approximately (e.g., ±10%) 40.0-60.0 inches, or within a range of approximately (e.g., ±10%) 45.0-55.0 inches, or within a range of approximately (e.g., ±10%) 48.0-52.0 inches, or approximately (e.g., ±10%) 49 29/32 inches.

In the illustrated embodiment, the upper bearing member 42 is rotatably connected to the connector bracket 40 via the bolt 104, thereby enabling the upper bearing member 42 to rotate about a rotational axis A1. In some embodiments, the rotational axis A1 may be perpendicular to the rotational axis A2. Rotation of the upper bearing member 42 helps maintain flush engagement between the upwardly facing convex surface 112 and the downwardly facing concave surface 46 while these surfaces slide against each another during seismic motions. The downwardly facing planar surface 110 of the upper bearing member 42 may be spaced apart from an upwardly facing surface 116 of the interior wall 76 so that there is clearance for the upper bearing member 42 to rotate. This clearance may be less than what is needed for the upper bearing member 42 to rotate a full 360 degrees within the upper cavity 78. In an alternative embodiment (not illustrated), the upper bearing member 42 may have a circular cross section and may be configured to rotate 360 degrees around the rotational axis A2. In such an embodiment, the upper bearing member 42 may roll, instead of slide, against the downwardly facing concave surface 46 of the upper rail member 22 during seismic motions. In a further alternative embodiment (not illustrated), the upper bearing member 42 may be fixed relative to the connector bracket 40, or even integrally formed with the connector bracket 40, such that the upper bearing member 42 does not rotate or otherwise move relative to the connector bracket 40.

Figure 8:
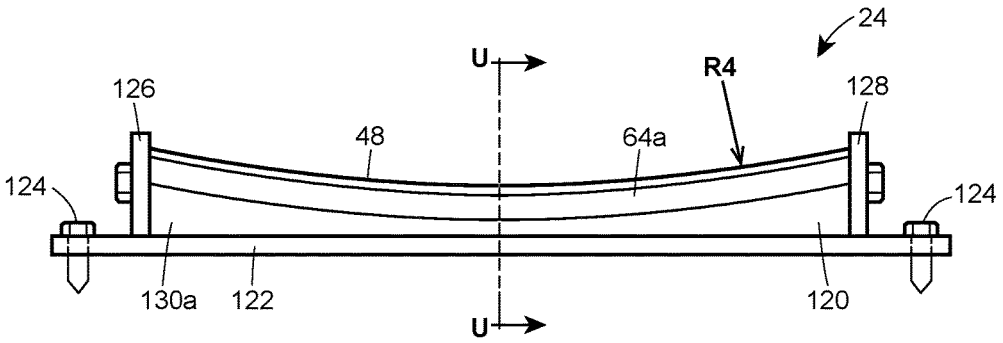
FIG. 8 is a side view of a lower rail member of the seismic damping system shown in FIG. 2.
Figure 11:
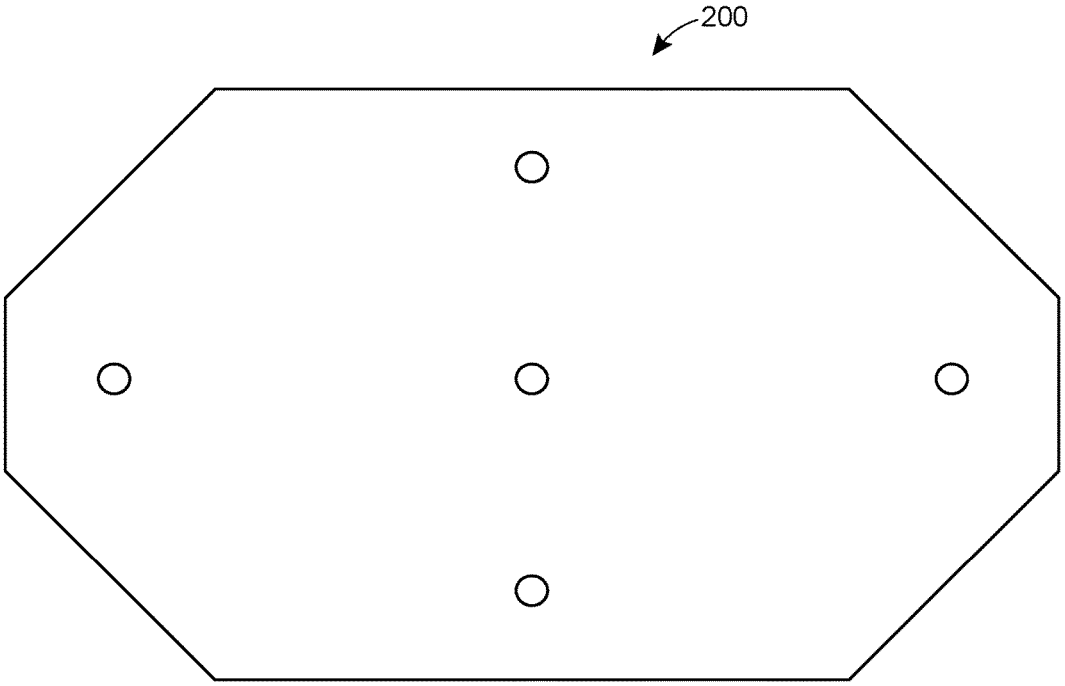
FIG. 11 is a top view of an alternative embodiment of a mounting plate for the upper and lower rail members.

Aspects of the lower rail member 24 will now be described with reference to FIGS. 8 and 9*a*. FIG. 8 shows that the lower rail member 24 may include a main body 120 fixedly connected to a mounting plate 122. The mounting plate 122 may include one or more holes for one or more bolts 124 for anchoring the lower rail member 22 to the foundation 12. The mounting plate 122 may have a rectangular cross-section as shown in FIGS. 2 and 3, or any other suitable shape, including a hexagonal shape such as the alternative embodiment of the mounting plate 200 illustrated in FIG. 11. The shape of the mounting plate 122 may be chosen to adequately distribute the weight of the architectural structure 10 over a surface area of the foundation 12.

The main body 120 of the lower rail member 24 includes the upwardly facing concave surface 48, as well as vertically extending first and second planar side surfaces 130*a* and 130*b* arranged on opposite sides of the upwardly facing concave surface 48. As seen in FIG. 9*a*, the groove 64*a* may be formed in the side surface 130*a*, and the groove 64*b* may be formed in the side surface 130*b*. In some embodiments, each of the grooves 64*a* and 64*b* may have a depth X2 equal to approximately (e.g., ±10%) 0.5 inches, and a width W2 equal to approximately (e.g., ±10%) 0.75 inches. As shown in FIG. 4, each of the grooves 64*a* and 64*b* may be dimensioned so that they can receive, respectively, the uplift restraint members 54*a* and 54*b* without the uplift restraint members 54*a* and 54*b* contacting the walls of their respective grooves 64*a* and 64*b*, except during vertical seismic motions or other lateral forces inducing uplift or overturning. In alternative embodiments (not illustrated), the uplift restraint members 54*a* and 54*b* may fit snugly in their respective grooves 64*a* and 64*b*, so that the uplift restraint members 54*a* and 54*b* contact the walls of their respective grooves 64*a* and 64*b* even in the absence of vertical seismic motions. In such alternative embodiments, the uplift restraint members 54*a* and 54*b* may slide or roll against the walls of their respective grooves 64*a* and 64*b* during horizontal seismic motions. Each of the grooves 62*a* and 62*b* may define a respective concentric curve (e.g., a concentric circular curve) with the downwardly facing concave surface 46 of the upper rail member 22. Similarly, each of the grooves 64*a* and 64*b* may define a respective concentric curve (e.g., a concentric circular curve) with the upwardly facing concave surface 48 of the lower rail member 24.

Figure 9A:
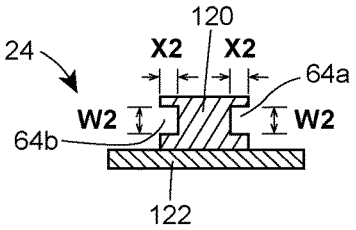
FIG. 9*a* is a cross-sectional view of the lower rail member taken along line U-U of FIG. 8.

Still referring to FIGS. 8 and 9*a*, the upwardly facing concave surface 48 may possess a radius of curvature R4 within a range of approximately (e.g., ±10%) 40.0-60.0 inches, or within a range of approximately (e.g., ±10%) 45.0-55.0 inches, or within a range of approximately (e.g., ±10%) 48.0-52.0 inches, or approximately (e.g., ±10%) 50 inches. In some embodiments, the radius of curvature R4 of the upwardly facing concave surface 48 of the lower rail member 24 may be slightly larger than (e.g., 3/32 inches larger than) the radius of curvature R2 of the downwardly facing convex surface 98 of the lower bearing member 44, so that the upwardly facing concave surface 48 can maintain flush engagement with the downwardly facing convex surface 98 while these surfaces slide against each another during seismic motions. Also, in some embodiments, each of the downwardly facing convex surface 98 of the lower bearing member 44, the upwardly facing concave surface 48 of the lower rail member 24, and the grooves 64*a* and 64*b* may define a respective concentric curve (e.g., concentric circular curve).

In use, the concavity of the upwardly facing concave surface 48 helps to re-center the lower bearing member 44 with the lower rail member 24 after a seismic event. More particularly, if the lower bearing member 44 is not located at the center of the of the upwardly facing concave surface 48 upon cessation of seismic activity, the weight of the architectural structure 10 will cause the lower bearing member 44 to slide along the downwardly upwardly facing concave surface 48 until it settles at the center of the upwardly facing concave surface 48. Accordingly, the architectural structure 10 may automatically return to its pre-seismic event position in the x- or y-direction as a result of the upwardly facing concave surface 48.

With continued reference to FIG. 8, the lower rail member 24 may additionally include first and second stop members 126 and 128. The first and second stop members 126 and 128 may be fixedly connected to opposite ends of the main body 120 to define respective endpoints for the sliding or rolling movement of the lower bearing member 44. Each of the first and second stop members 126 and 128 may extend upwardly from the upwardly facing concave surface 48 to form a respective vertical lip that prevents the lower bearing member 44 from moving beyond the respective stop member.

The lower rail member 24, including the upwardly facing concave surface 48, may be made of metal (e.g., steel or stainless steel), or any other suitable material. The material chosen for the upwardly facing concave surface 48 should permit the downwardly facing convex surface 98 of the lower bearing member 44 to slide against the upwardly facing concave surface 48, but also create friction therebetween, so that a portion of the kinetic energy released by the seismic event can be dissipated as heat.

Referring back to FIG. 4, details of the upper rail member 22 will now be described. The upper rail member 22 may include a main body 140 fixedly connected to a mounting plate 142. The mounting plate 142 may include one of more holes for one or more bolts 144 to anchor the mounting plate 142 to the base member 18. The mounting plate 142 may have a rectangular cross-section as shown in FIGS. 2 and 3, or any other suitable shape, including a hexagonal shape such as the alternative embodiment of the mounting plate 200 illustrated in FIG. 11.

Figure 9B:
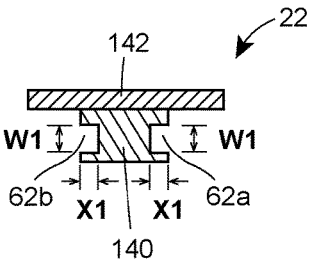
FIG. 9*b* is a cross-sectional view of the upper rail member taken along line T-T of FIG. 4.

The main body 140 of the upper rail member 22 includes the downwardly facing concave surface 46, as well as vertically extending first and second planar side surfaces 150*a* and 150*b* arranged on opposite sides of the downwardly facing concave surface 46. As seen in FIG. 9*b*, the groove 62*a* may be formed in the side surface 150*a*, and the groove 62*b* may be formed in the side surface 150*b*. In some embodiments, each of the grooves 62*a* and 62*b* may have a depth X1 equal to approximately (e.g., ±10%) 0.5 inches, and a width W2 equal to approximately (e.g., ±10%) 0.75 inches. Each of the grooves 62*a* and 62*b* may be dimensioned so that they can receive, respectively, the uplift restraint members 52*a* and 52*b* without the uplift restraint members 52*a* and 52*b* contacting the walls of their respective grooves 62*a* and 62*b*, except during vertical seismic motions. In alternative embodiments (not illustrated), the uplift restraint members 52*a* and 52*b* may fit snugly in their respective grooves 62*a* and 62*b*, so that the uplift restraint members 52*a* and 52*b* contact the walls of their respective grooves 62*a* and 62*b* even in the absence of vertical seismic motions. In such alternative embodiments, the uplift restraint members 52*a* and 52*b* may slide or roll against the walls of their respective grooves 62*a* and 62*b* during horizontal seismic motions.

Still referring to FIG. 4, the downwardly facing concave surface 46 may possess a radius of curvature R3 within a range of approximately (e.g., ±10%) 40.0-60.0 inches, or within a range of approximately (e.g., ±10%) 45.0-55.0 inches, or within a range of approximately (e.g., ±10%) 48.0-52.0 inches, or approximately (e.g., ±10%) 50 inches. In some embodiments, the radius of curvature R3 of the downwardly facing concave surface 46 of the upper rail member 22 may be slightly larger than (e.g., 3/32 inches larger than) the radius of curvature R1 of the upwardly facing convex surface 112 of the upper bearing member 42, so that the downwardly facing concave surface 46 can maintain flush engagement with the upwardly facing convex surface 112 while these surfaces slide against each another during seismic motions. Also, in some embodiments, each of the upwardly facing convex surface 112 of the upper bearing member 42, the downwardly facing concave surface 46 of the upper rail member 22, and the grooves 62*a* and 62*b* may define a respective concentric curve (e.g., a concentric circular curve).

In use, the concavity of the downwardly facing concave surface 46 helps to re-center the upper bearing member 42 with the upper rail member 22 after a seismic event. More particularly, if the upper bearing member 42 is not located at the center of the of the downwardly facing concave surface 46 upon the cessation of seismic activity, the weight of the architectural structure 10 will cause the upper bearing member 42 to slide along the downwardly facing concave surface 46 until it settles at the center of the downwardly facing concave surface 46. Accordingly, the architectural structure 10 may automatically return to its pre-seismic event position in the x- or y-direction as a result of the downwardly facing concave surface 46.

With continued reference to FIG. 4, the upper rail member 22 may additionally include first and second stop members 146 and 148. The first and second stop members 146 and 148 may be fixedly connected to opposite ends of the main body 140 to define respective endpoints for the sliding or rolling movement of the upper bearing member 42. Each of the first and second stop members 146 and 148 may extend downwardly from the downwardly facing concave surface 46 to form a respective vertical lip that prevents the upper bearing member 42 from moving beyond the respective stop member.

The upper rail member 22, including the downwardly facing concave surface 46, may be made of metal (e.g., steel or stainless steel), or any other suitable material. The material chosen for the downwardly facing concave surface 46 should permit the upwardly facing convex surface 112 of the upper bearing member 42 to slide against the downwardly facing concave surface 46, but also create friction therebetween, so that a portion of the kinetic energy released by the seismic event can be dissipated as heat.

Figure 10:
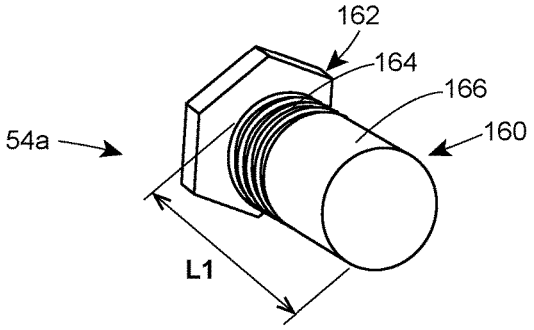
FIG. 10 is a perspective view of an uplift restraint member used by the seismic damping system of FIG. 2.

Referring now to FIG. 10, the structure of the uplift restraint member 54*a* will now be described. The uplift restraint members 52*a*, 52*b*, and 54*b* may be constructed in a similar manner as the uplift restraint member 54*a*, and therefore, for the sake of brevity are not described below. The uplift restraint member 54*a* may be configured as a bolt and include a shaft 160 and an enlarged head 162. The shaft 160 may have a circular cross section with a diameter equal to approximately (e.g., ±10%) 0.625 inches, or within a range of approximately (e.g., ±10%) 0.4-0.8 inches, or within a range of approximately (e.g., ±10%) 0.5-0.7 inches. The circular cross section of the shaft 160 may facilitate sliding against the walls of the groove 64 during vertical seismic motions; however, other cross-sectional shapes for the shaft 160 are envisioned, including a square or rectangular cross-sectional shape.

The shaft 160 may have a length L1 which is greater than a thickness of the wall 74*a* of the connector bracket 40, so that the shaft 160 can be inserted through the wall 74*a* and into the groove 64*a*. Furthermore, a portion of the shaft 160 may have a threaded exterior surface 164 for threadably engaging a threaded inner surface of the hole 84*a*. Accordingly, the uplift restraint member 54*a* may be fixedly connected to the connector bracket 40 by screwing the shaft 160 through the hole 84*a*. The enlarged head 162 of the uplift restraint member 54*a* may interface with a tool such as a wrench to facilitate this screwing motion. Furthermore, a non-threaded exterior surface 166 of the shaft 160 may be machined smooth so that it can slide against the walls of the groove 64*a* during vertical seismic motions.

Each of the uplift restraint members 52*a*, 52*b*, and 54*b* may be made of rigid material including, but not limited to, metal (e.g., steel or stainless steel).

While each of the uplift restraint members 52*a*, 52*b*, 54*a*, and 54*b* of the present embodiment constitutes a separate element, in alternative embodiments, one or more of the uplift restraint members 52*a*, 52*b*, 54*a*, and 54*b* may be integrally formed with the connector bracket 40, the upper bearing member 42, and/or the lower bearing member 44.

The operation of the seismic damping system 14 during a seismic event will now be described with reference to FIGS. 1-3. Prior to the seismic event, the upwardly facing convex surface 112 of the upper bearing member 42 may rest against a central portion of the downwardly facing concave surface 46 of the upper rail member 22, and the downwardly facing convex surface 98 of the lower bearing member 44 may rest against a central portion of the upwardly facing concave surface 48 of the lower rail member 22, as illustrated in FIGS. 2 and 3. During the seismic event, the foundation 12 may shift in the x-direction, the y-direction, and/or the z-direction. As a result, the upwardly facing convex surface 112 of the upper bearing member 42 may slide against the downwardly facing concave surface 46 of the upper rail member 22 in the x-direction away from the central portion of the downwardly facing concave surface 46. Simultaneously, the downwardly facing convex surface 98 of the lower bearing member 44 may slide against the upwardly facing concave surface 48 of the lower rail member 22 in the y-direction away from the central portion of the downwardly facing concave surface 46. Also, if the seismic motions include a z-direction component, each of the uplift restraint members 52*a*, 52*b*, 54*a*, and 54*b* may engage and be restrained by the walls of its corresponding groove 62*a*, 62*b*, 64*a*, or 64*b*. Accordingly, the uplift restraint members 52*a*, 52*b*, 54*a*, and 54*b* may prevent the upper and lower rail members 22 and 24 from being separated from each other in the z-direction. Upon cessation of the seismic motions, the weight of the architectural structure 10 may cause the upper bearing member 42 to slide along the downwardly facing concave surface 46 until it settles at the central portion of the downwardly facing concave surface 46, and cause the lower bearing member 44 to slide along the downwardly upwardly facing concave surface 48 until it settles at the central portion the upwardly facing concave surface 48. Accordingly, the upwardly and downwardly facing concave surfaces 46 and 48 may help re-center upper and lower rail members 22 and 24 after the seismic event, thereby returning the architectural structure 10 to its pre-seismic event position relative to the foundation 12.

A method of assembling the seismic damping system 14 may involve the following steps. Initially, the upper bearing member 42 may be connected between the first pair of opposing walls 72*a* and 72*b* by aligning the hole 106 of the upper bearing member 42 with the holes 84*a* and 84*b* in the connector bracket 40 and inserting the bolt 104 therethrough. The bolt 104 then may be tightened against the connector bracket 40 with the nut 108. Before or after connecting the upper bearing member 42, the lower bearing member 44 may be connected between the second pair of opposing walls 74*a* and 74*b* by aligning the hole 92 of the lower bearing member 44 with the holes 88*a* and 88*b* in the connector bracket 40 and inserting the bolt 90 therethrough. The bolt 90 may then be tightened against the connector bracket 40 with the nut 94.

Next, the upper rail member 22 may be inserted into the upper cavity 78 of the connector bracket 40 until the grooves 62*a* and 62*b* are aligned their corresponding holes 82*a* and 82*b* in the connector bracket 40 and the downwardly facing concave surface 46 contacts the upwardly facing convex surface 112 of the upper bearing members 42. Then, the uplift restraint members 52*a* and 52*b* may be screwed through their corresponding holes 82*a* and 82*b* in the connector bracket 40 and received in their corresponding grooves 62*a* and 62*b*. Subsequently, the lower rail member 24 may be inserted into the lower cavity 80 of the connector bracket 40 until the grooves 64*a* and 64*b* are aligned with corresponding holes 88*a* and 88*b* in the connector bracket 40 and the upwardly facing concave surface 48 contacts the downwardly facing convex surface 98 of the lower bearing member 44. Then, the uplift restraint members 64*a* and 64*b* may be screwed through their corresponding holes 88*a* and 88*b* in the connector bracket 40 and received in their corresponding grooves 64*a* and 64*b*. Installing the uplift restrain members 62*a*, 62*b*, 64*a*, and 64*b* in this manner is relatively straightforward and may not be very labor-intensive.

Referring back to FIG. 1, a single architectural structure 10 may be installed with a plurality of seismic damping systems 14 in accordance with the present disclosure. The seismic damping systems 14 may be spaced at regular intervals along the foundation 12 (e.g., spaced at regular intervals around the perimeter of the foundation 12). In some embodiments, the spacing may be determined based on factors such as the geographic location, unique characteristics of the architectural structure 10, and/or interior support locations of the architectural structure 10.

One benefit of the seismic damping system 14 of the present disclosure is the relative ease with which it can interface with the foundation 12 and base member 18 of an architectural structure 10, including light-frame construction. Little or no modification to the foundation 12 and/or base member 18 may be required in order to accommodate the seismic damping system 14. Accordingly, the seismic damping system 14 may not substantially increase construction costs and/or time.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A bearing assembly for a seismic damping system, the bearing assembly comprising:

a connector bracket including a first pair of opposing walls defining an upper cavity and a second pair of opposing walls defining a lower cavity;

a first bearing member disposed in the upper cavity and connected between the first pair of opposing walls, wherein the first bearing member has a non-circular cross-section such that an end surface of the first bearing member facing a wall of the first pair of opposing walls has a non-circular outer periphery, and wherein the first bearing member is configured to rotate relative to the connector bracket during seismic motions;

a second bearing member disposed in the lower cavity and connected between the second pair of opposing walls;

a first pair of uplift restraint members extending into the upper cavity from respective walls of the first pair of opposing walls; and a second pair of uplift restraint members extending into the lower cavity from respective walls of the second pair of opposing walls.

2. The bearing assembly of claim 1, each uplift restraint member of the first pair of uplift restraint members being mounted through a respective hole in the connector bracket.

3. The bearing assembly of claim 2, each uplift restraint member of the first pair of uplift restraint members being aligned along a first axis, each uplift restraint member of the second pair of uplift restraint members being aligned along a second axis, the first axis being perpendicular to the second axis.

4. The bearing assembly of claim 1, the first bearing member including an upwardly facing convex surface, and the second bearing member including a downwardly facing convex surface.

5. The bearing assembly of claim 4, the first bearing member being configured to rotate relative to the connector bracket about a first rotational axis, the second bearing member being configured to rotate relative to the connector bracket about a second rotational axis, the first rotational axis being perpendicular to the second rotational axis.

6. The bearing assembly of claim 5, the connector bracket including an interior wall separating the upper cavity and the lower cavity, the interior wall connecting the first pair of opposing walls and the second pair of opposing walls.

7. The bearing assembly of claim 6, the first bearing member including a lower surface spaced apart from the interior wall to provide clearance for the first bearing member to rotate.

8. The bearing assembly of claim 1, at least one of the first bearing member or the second bearing member having a convex surface, the convex surface having a radius of curvature within a range of approximately 40.0-60.0 inches.

9. The bearing assembly of claim 1, the first bearing member having a convex upper surface and a non-convex lower surface.

10. A system for damping seismic motions transmitted to a structure, the system comprising:

an upper rail member including a first concave surface and a first groove, the first concave surface facing in a downward direction and defining a first sliding path in a first direction;

a lower rail member including a second concave surface and a second groove, the second concave surface facing in an upward direction and defining a second rolling or sliding path in a second direction;

a connector bracket disposed between the upper rail member and the lower rail member;

an upper bearing member disposed between a first pair of opposing walls of the connector bracket and configured to slide against the first concave surface in the first direction and rotate relative to the connector bracket during seismic motions, wherein the upper bearing member has a non-circular cross-section such that an end surface of the upper bearing member facing a wall of the first pair of opposing walls has a non-circular outer periphery;

a lower bearing member disposed between a second pair of opposing walls of the connector bracket and configured to slide or roll against the second concave surface in the second direction during seismic motions;

a first uplift restraint member extending inwardly from one of the walls of the first pair of opposing walls and received in the first groove; and a second uplift restraint member extending inwardly from one of the walls of the second pair of opposing walls and received in the second groove.

11. The system of claim 10, the first uplift restraint member being mounted through a first hole in the connector bracket, and the second uplift restraint member being mounted through a second hole in the connector bracket.

12. The system of claim 11, the first uplift restraint member including a first bolt threadably received in the first hole, and the second uplift restraint member including a second bolt threadably received in the second hole.

13. The system of claim 10, wherein the first groove and the first concave surface define concentric curves.

14. The system of claim 10, the first direction of the first sliding path being perpendicular to the second direction of the second rolling or sliding path.

15. The system of claim 10, the upper bearing member including a convex surface facing in the upward direction and configured to slide against the first concave surface during seismic motions.

16. The system of claim 15, the upper bearing member being configured to rotate relative to the connector bracket as the upper convex surface slides against the first concave surface during seismic motions.

17. The system of claim 10, the upper bearing member including a lower surface spaced apart from an upwardly facing surface of an interior wall of the connector bracket to provide clearance for the upper bearing member to rotate during seismic motions.

18. The system of claim 10, the first uplift restraint member being configured to slide within or roll against the first groove during seismic motions.

19. The system of claim 10, further comprising:

a third groove formed in the upper rail member, the first groove and the third groove being arranged on opposite sides of the upper rail member;

a third uplift restraint member extending inwardly from the other one of the walls of the first pair of opposing walls and received in the third groove;

a fourth groove formed in the lower rail member, the second groove and the fourth groove being arranged on opposite sides of the lower rail member; and a fourth uplift restraint member extending inwardly from the other one of the walls of the second pair of opposing walls and received in the fourth groove.

20. The system of claim 10, at least one of the upper bearing member or the lower bearing member having a convex surface, the convex surface having a radius of curvature within a range of approximately 40.0-60.0 inches.

21. The system of claim 10, the upper bearing member having a convex upper surface and a non-convex lower surface.

22. A method of assembling a seismic damping system including an upper rail member, a lower rail member, and a connector bracket, the method comprising:

connecting an upper bearing member between a first pair of opposing walls of the connector bracket, wherein the upper bearing member has a non-circular cross-section such that an end surface of the upper bearing member facing a wall of the first pair of opposing walls has a non-circular outer periphery, and wherein the upper bearing member is configured to rotate relative to the connector bracket during seismic motions;

connecting a lower bearing member between a second pair of opposing walls of the connector bracket;

arranging the upper rail member between the first pair of opposing walls of the connector bracket such that a downwardly facing concave surface of the upper rail member engages the upper bearing member;

arranging the lower rail member between the second pair of opposing walls of the connector bracket such that an upwardly facing concave surface of the lower rail member engages the lower bearing member;

inserting a first uplift restraint member through a first hole in the connector bracket and into a first groove in the upper rail member; and inserting a second uplift restraint member through a second hole in the connector bracket and into a second groove in the lower rail member.

23. The method of claim 22, wherein inserting the first uplift restraint member through the first hole in the connector bracket and into the first groove in the upper rail member comprises screwing a threaded portion of the first uplift restraint member through the first hole after the upper rail member has been arranged between the first pair of opposing walls of the connector bracket.

24. The method of claim 22, wherein inserting the second uplift restraint member through the second hole in the connector bracket and into the second groove in the lower rail member comprises arranging the second uplift restraint member perpendicular to the first uplift restraint member.

25. The method of claim 22, at least one of the upper bearing member or the lower bearing member having a convex surface, the convex surface having a radius of curvature within a range of approximately 40.0-60.0 inches.

26. The method of claim 22, the upper bearing member having a convex upper surface and a non-convex lower surface.

* * * * *